US010167827B2

(12) United States Patent
Garrison

(10) Patent No.: US 10,167,827 B2
(45) Date of Patent: Jan. 1, 2019

(54) APPARATUS AND METHOD FOR USING A SINGLE INTAKE MANIFOLD ON DIFFERENT SIZES OF V-STYLE MOTORCYCLE ENGINE CYLINDERS

(71) Applicant: Midwest Motorcycle Supply Distributors Corp., Pevely, MO (US)

(72) Inventor: John M. Garrison, Columbia, IL (US)

(73) Assignee: MIDWEST MOTORCYCLE SUPPLY DISTRIBUTORS CORP., Pevely, MO (US)

( * ) Notice: Subject to any disclaimer, the term of this patent is extended or adjusted under 35 U.S.C. 154(b) by 0 days.

(21) Appl. No.: 14/202,469

(22) Filed: Mar. 10, 2014

(65) Prior Publication Data

US 2014/0261276 A1 Sep. 18, 2014

Related U.S. Application Data

(60) Provisional application No. 61/799,611, filed on Mar. 15, 2013.

(51) Int. Cl.

| | |
|---|---|
| ***F02M 35/10*** | (2006.01) |
| ***F02M 35/104*** | (2006.01) |
| *F02M 35/112* | (2006.01) |

(52) U.S. Cl.

CPC ..... *F02M 35/104* (2013.01); *F02M 35/10144* (2013.01); *F02M 35/10321* (2013.01);

(Continued)

(58) Field of Classification Search

CPC ..... F02M 35/10321; F02M 35/10144; F02M 35/112; F02M 35/10347; F02M 35/0347; F05C 2225/08

(Continued)

(56) References Cited

U.S. PATENT DOCUMENTS 4,440,120 A * 4/1984 Butler ..... F02B 75/22 123/184.34
4,480,600 A * 11/1984 Gill ..... F02B 75/22 123/195 R (Continued)

OTHER PUBLICATIONS

Honda Corporation, Motorcycle Product News, Dec. 12, 1978, Honda, 1-2 (Plus Translation).*
Bikez.com website, 1977 Honda CB750 K specifications and pictures, 2003, 2006-2008, 1-3 (Plus Dating Website).*
Dynoman website—www.dynoman.net, Parts for Honda Motorcycles, 2004, Honda Section; 4th Row Down.*

(Continued)

*Primary Examiner* — Lindsay Low
*Assistant Examiner* — Charles Brauch
(74) *Attorney, Agent, or Firm* — Thompson Coburn LLP

(57) ABSTRACT

A modular intake manifold for a V-style motor cycle engine is configured to interface with manifold ports on cylinder heads of a first engine and with manifold ports on cylinder heads of a second engine. The first engine has cylinders of a first length, and the second engine has cylinders of a second length larger than the first length. The manifold port of each cylinder head of the first engine is offset from the centerline of the respective cylinder bore by a first offset distance. The manifold port of each cylinder head of the second engine is offset from the centerline of the respective cylinder bore by a second offset distance that is greater than the first offset distance. A method includes manufacturing the first cylinder and second cylinders, the first and second cylinder heads, and the intake manifold with the respective same considerations.

4 Claims, 3 Drawing Sheets

(52) U.S. Cl.
CPC ..... *F02M 35/10347* (2013.01); *F02M 35/112* (2013.01); *F05C 2225/08* (2013.01); *Y10T 29/4927* (2015.01)

(58) Field of Classification Search
USPC ..... 123/184.21
See application file for complete search history.

(56) References Cited

U.S. PATENT DOCUMENTS

| | | | | |
|---|---|---|---|---|
| 2007/0163831 | A1* | 7/2007 | Stevens | B62M 7/02 180/219 |
| 2012/0024254 | A1* | 2/2012 | Shibazaki | 123/184.21 |

OTHER PUBLICATIONS

Western Honda Powersports, 1977 Honda CB 750K Cylinder Head Drawing, pp. 1-2.*
Western Honda Powersports, 1978 Honda CB750K Cylinder Head Drawings, pp. 1-2.*
Partzilla, Western Honda Powersports Honda CB750K Cylinder Head Schematic Date, publically available as copyrighted in 2002-2013, p. 1.*
Empius Corporation, Empius.Com, 1999, Wayback Machine.*
Empius Corporation, Engine Components, 2016, Empius.Com, 2016 Online Catalog, 20.*
Empius Corporation, Model Identification, 2016, Empius.com, 2016 Online Catalog, Model Identification.*
Jawzys, Intake Manifold S&S Cycle 16-1200, 2017, Ebay, 2.*

* cited by examiner

| CYL BORE | X1 | X2 | DIM 'A' |
|---|---|---|---|
| | | | |
| 4.000 | 5.875 | 4.995 | 2.47 |
| 4.250 | 5.975 | 5.030 | 2.59 |
| 4.400 | 6.150 | 5.340 | 2.94 |

APPARATUS AND METHOD FOR USING A SINGLE INTAKE MANIFOLD ON DIFFERENT SIZES OF V-STYLE MOTORCYCLE ENGINE CYLINDERS

CROSS REFERENCE TO RELATED APPLICATIONS

This application claims the benefit of provisional application Ser. No. 61/799,611 filed Mar. 15, 2013, the disclosure of which is incorporated by reference herein.

BACKGROUND

This disclosure pertains to motorcycle engines. More particularly, this disclosure relates to V-style motorcycle engines and a modular intake manifold that may be used in connection with a variety of V-style engine sizes. In particular, the cylinder heads for a plurality of V-style engine sizes may each be formed to utilize the same intake manifold. In particular, a cylinder head for a respective engine size may have the dimension from the center of the cylinder bore to the manifold receiving port increased for each corresponding increase in engine size so the same intake manifold may be used for engines of various sizes.

SUMMARY

In one aspect, the invention comprises a modular intake manifold. The intake manifold is configured to interface with manifold ports on cylinder heads of a first engine and with manifold ports on cylinder heads of a second engine. The first engine has cylinders of a first length. The second engine has cylinders of a second length. The second length is larger than the first length. The manifold port of each cylinder head of the first engine is offset from the centerline of the respective cylinder bore by a first offset distance. The manifold port of each cylinder head of the second engine is offset from the centerline of the respective cylinder bore by a second offset distance. The second offset distance is greater than the first offset distance.

Another aspect of the invention comprises a method. In accordance with one step of the method, a first cylinder of a first length is manufactured. The first cylinder has a cylinder bore centerline. In accordance with another step of the method, a first cylinder head is manufactured. The first cylinder head is adapted and configured to mount to the first cylinder. The first cylinder head has an intake manifold port. The intake manifold port is adapted to be a first offset distance from the cylinder bore centerline of the first cylinder when the first cylinder head is mounted thereto. In accordance with another step of the method, a second cylinder of a second length is manufactured. The second length is larger than the first length. The second cylinder has a cylinder bore centerline. In accordance with another step of the method, a second cylinder head is manufactured. The second cylinder head is adapted and configured to mount to the second cylinder. The second cylinder head has an intake manifold port. The intake manifold port of the second cylinder head is adapted to be a second offset distance from the cylinder bore centerline of the second cylinder when the second cylinder head is mounted thereto. The second offset distance is greater than the first offset distance so that a common size intake manifold can be used with either the first or second cylinder.

Another aspect of the invention comprises a method. In accordance with one step of the method, an intake manifold is provided. The intake manifold is configured to interface with manifold ports on cylinder heads of a first engine and with manifold ports on cylinder heads of a second engine. The first engine has cylinders of a first length, and the second engine having cylinders of a second length larger than the first length. The manifold port of each cylinder head of the first engine is offset from the centerline of the respective cylinder bore by a first offset distance. The manifold port of each cylinder head of the second engine is offset from the centerline of the respective cylinder bore by a second offset distance greater than the first offset distance. In accordance with a step of the method, a user is directed to install the intake manifold on at least one of the first and second engine.

Further features and advantages of the present invention, as well as the operation of the invention, are described in detail below with reference to the accompanying drawings.

DESCRIPTION OF THE DRAWINGS

FIG. 2 depicts dimensions "X1", "X2" of the cylinder that commonly vary with engine size.

FIG. 3 depicts a dimension "A" of the intake manifold that varies with engine size.

FIG. 5 depicts a dimension of the cylinder head Y that varies with changes in dimensions X1,X2 of the cylinder of the engine shown in FIG. 2.

DETAILED DESCRIPTION

Figure 1:
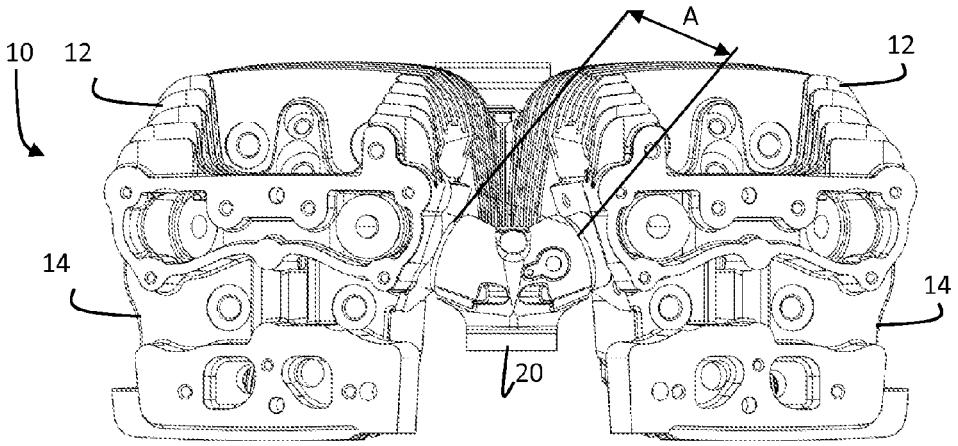
FIG. 1 shows a partial, top view of a motorcycle V-style engine with cylinder heads mounted to cylinders of the engine with rocker boxes, valves, and valve covers removed to expose the internals of the cylinder head and with a conventional intake manifold mounted to the cylinder heads.
Figure 2:
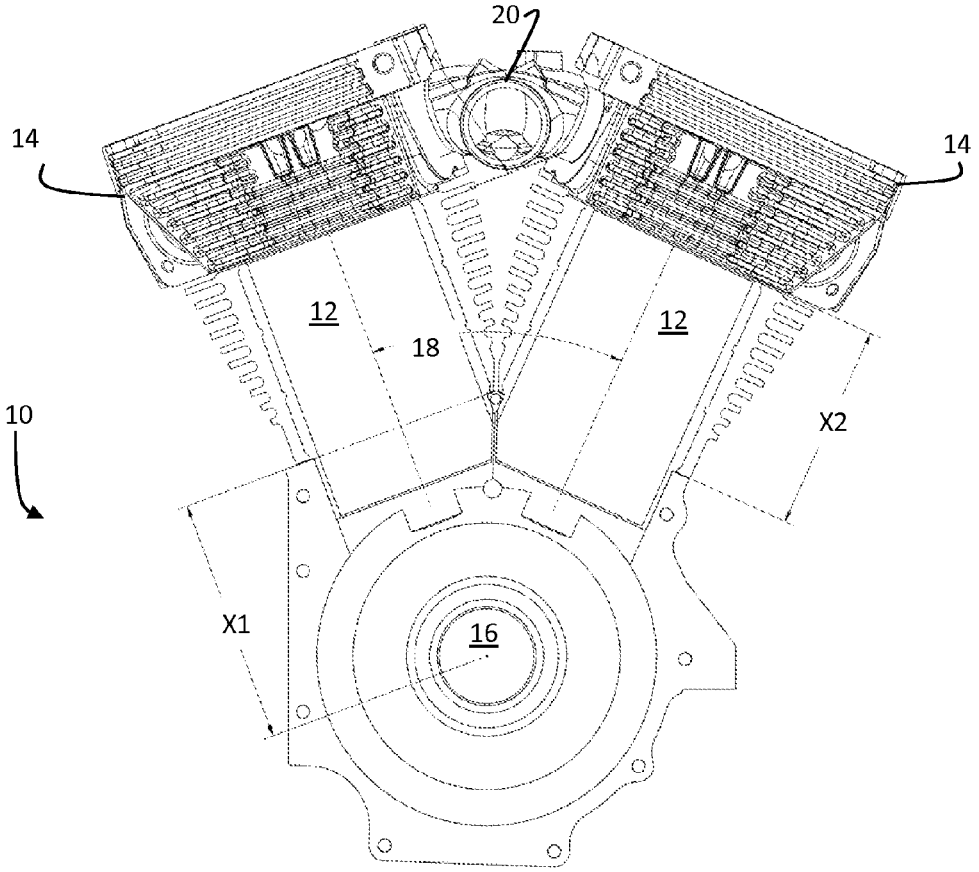
FIG. 2 is a side view of the motorcycle V style engine of FIG. 1, and in particular.

FIGS. 1-2 show the cylinder arrangement of a V-style motorcycle engine 10. The engine 10 comprises two cylinders 12 and a head 14 for each cylinder, which contains the valves. For ease of illustration, the valves, rocker box, and valve covers are not shown. The cylinders 12 of the engine form a "V" shape extending from the engine block 16 with an angle 18. The angle 18 of the "V" may be 45 degrees. The angle 18 may vary from engine to engine, for instance, to reduce vibration. Although two cylinders 14 are shown, the principles discussed herein may be used in connection with a four-cylinder or six-cylinder V-style engine. For instance, in a four-cylinder, V-style engine, two cylinders are generally arranged on each side of the "V". As shown in FIGS. 1 and 2, certain cylinder length dimensions X1,X2 may be varied to increase the power output of the engine. The size of the combustion chamber (i.e., cylinders) of the engine is directly related to its power output. Typical sizes may between about 100 cubic centimeters and about 1500 cubic centimeters (cc). FIGS. 1-2 show a conventional intake manifold 20 extending between the cylinder heads 14. The intake manifold 20 directs the fuel-air mixture to valve ports in the cylinder heads. The valves (not show) open and close to allow the fuel-air mixture to enter the combustion chamber in the cylinders.

Figures 3, 4:
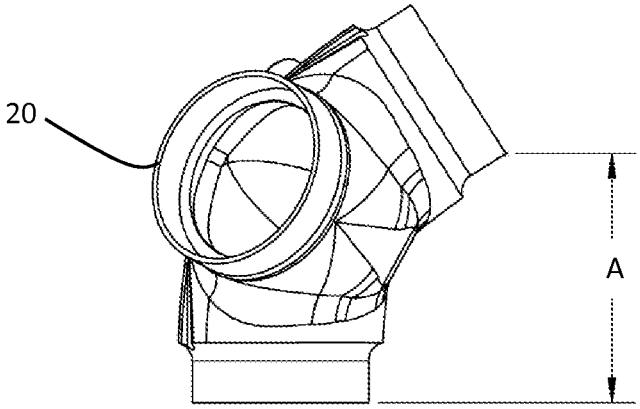
FIG. 3 illustrates the conventional intake manifold of FIG. 1, and in particular.
FIG. 4 is an exemplary chart showing typical differences in dimension A of the conventional intake manifold of FIG. 3 for dimensions X1,X2 of the cylinder of the engine shown in FIG. 2.

In conventional designs, each unique size of the cylinder 12 requires a unique size intake manifold 20. This is because, as the cylinder length dimensions X1,X2 change, the top portions of the cylinder heads grow further apart (due to the V-style orientation of the cylinders). FIG. 3 shows a conventional intake manifold 20 for a particular size of V-style engine with intake manifold spanning dimension "A". For each size engine and cylinder length dimension X1,X2 increase, intake manifold spanning dimension "A" increases. FIG. 4 is a chart showing the intake manifold spanning dimension A for given cylinder bore and cylinder length dimensions X1,X2. The units in FIG. 4 are inches. As is evident from the chart of FIG. 4, unique intake manifolds are required to accommodate different cylinder length dimensions X1,X2. For instance, as shown in FIG. 4, as cylinder length dimensions X1,X2 increase with increasing size of the cylinders, the intake manifold spanning dimension A correspondingly increases. This reduces flexibility in supplying and manufacturing intake manifolds, as multiple parts must be manufactured, supplied, distributed, and carried in inventory.

Figure 5:
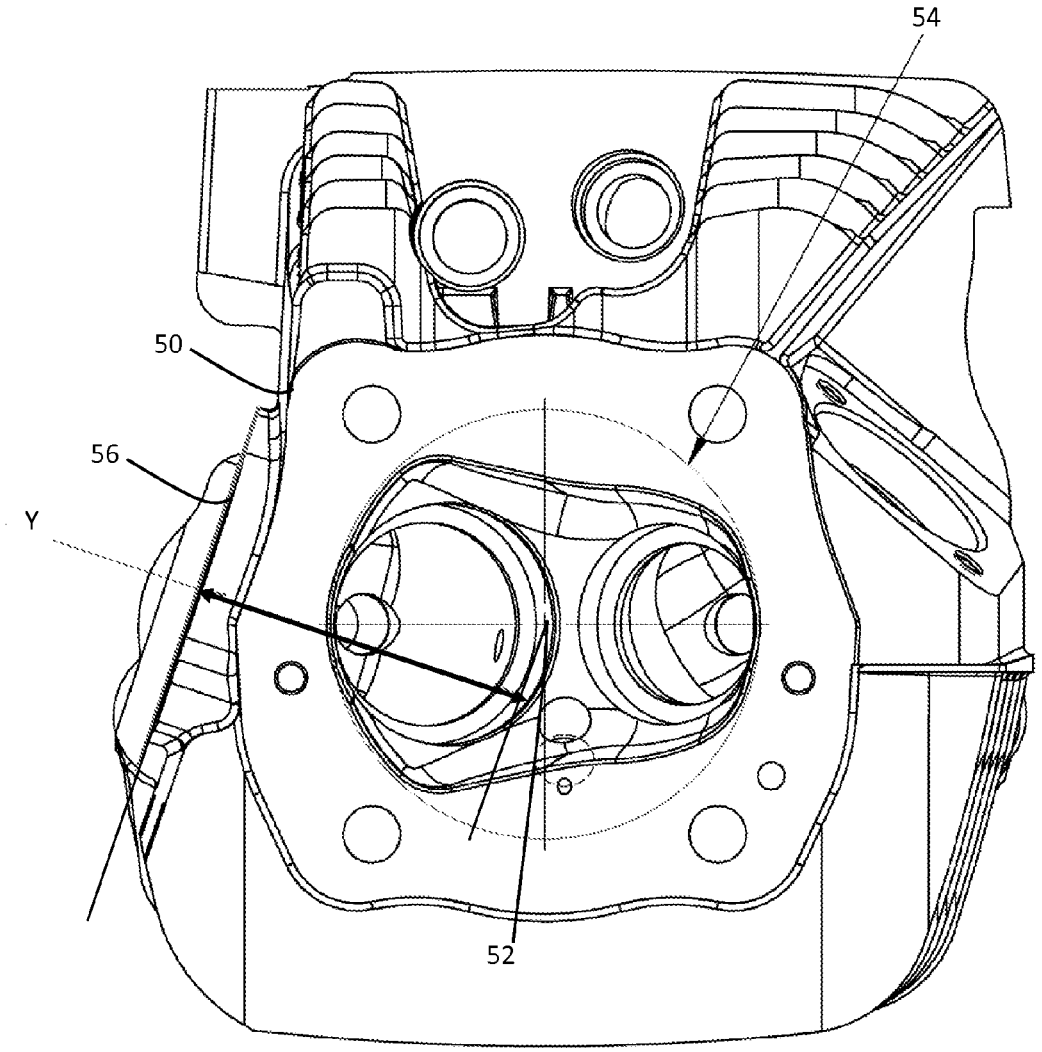
FIG. 5 shows a bottom view of a cylinder head provided in accordance with the disclosure, and in particular

To overcome the problems associated with having a unique intake manifold for each size of cylinder, an improved cylinder head 50 as shown in FIG. 5 may be provided. The cylinder head 50 of FIG. 5 has a dimension "Y" corresponding to the distance from a center 52 of the cylinder bore 54 to a manifold receiving port 56 that is increased to account for the greater span between the cylinders with increasing cylinder length dimensions X1,X2 and engine size. So, rather than increasing the intake manifold spanning dimension A as cylinder length dimensions X1,X2 increase, on the modified cylinder head 50 of FIG. 5, the cylinder head dimension Y is increased to account for the greater span between the cylinders. Thus, an intake manifold with a set spanning dimension A may be used in conjunction with various cylinder heads and cylinders of different length dimensions X1,X2.

While certain embodiments have been described in detail in the foregoing detailed description and illustrated in the accompanying drawings, those with ordinary skill in the art will appreciate that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

I claim:

1. A method comprising:

manufacturing a first cylinder of a first length, the first cylinder having a cylinder bore centerline;

manufacturing a first cylinder head that is adapted and configured to mount to the first cylinder, the first cylinder head having a intake manifold port, the intake manifold port being manufactured and designed to be a first offset distance from the cylinder bore centerline of the first cylinder when the first cylinder head is mounted thereto;

manufacturing a second cylinder of a second length, the second length being designed to be larger than the first length, the second cylinder having a cylinder bore centerline;

manufacturing a second cylinder head that is adapted and configured to mount to the second cylinder, the second cylinder head having a intake manifold port, the intake manifold port of the second cylinder head being manufactured and designed to be a second offset distance from the cylinder bore centerline of the second cylinder when the second cylinder head is mounted thereto, the second offset distance being designed to be greater than the first offset distance and yet such that a common size intake manifold can be used with either of the first or second cylinders.

2. A method comprising:

providing an intake manifold, the intake manifold being configured to interface with manifold ports on cylinder heads of a first engine and with manifold ports on cylinder heads of a second engine, the first engine having cylinders manufactured and designed to be of a first length, the second engine having cylinders manufactured and designed to be of a second length, the second length being larger than the first length, the manifold port of each cylinder head of the first engine being manufactured and designed to be offset from the centerline of the respective cylinder bore by a first offset distance, the manifold port of each cylinder head of the second engine being manufactured and designed to be offset from the centerline of the respective cylinder bore by a second offset distance, the second offset distance being designed to be greater than the first offset distance; and directing a user to install the intake manifold on either of the first and second engines.

3. The method of claim 2 further comprising directing the user to install the first cylinder head on the first engine.

4. The method of claim 2 further comprising directing the user to install the second cylinder head on the second engine.

* * * * *